United States Patent [19]

Miyashita et al.

[11] Patent Number: 4,510,030

[45] Date of Patent: Apr. 9, 1985

[54] METHOD FOR CATHODIC PROTECTION OF ALUMINUM MATERIAL

[75] Inventors: Teruo Miyashita; Koichi Yoshida, both of Ihara, Japan

[73] Assignee: Nippon Light Metal Company Limited, Tokyo, Japan

[21] Appl. No.: 521,753

[22] Filed: Aug. 9, 1983

[30] Foreign Application Priority Data

Dec. 21, 1982 [JP] Japan ..... 57-222980
Dec. 21, 1982 [JP] Japan ..... 57-222981

[51] Int. Cl.[3] ..... C23F 13/00

[52] U.S. Cl. ..... 204/147; 204/148; 204/196; 204/197

[58] Field of Search ..... 204/147, 148, 196, 197

[56] References Cited

U.S. PATENT DOCUMENTS 3,004,905 10/1961 Sabins ..... 204/197
3,242,064 3/1966 Byrne ..... 204/196
3,360,452 12/1967 McNulty ..... 204/197
3,622,489 11/1971 Dumitrescu et al. ..... 204/197
3,634,222 1/1972 Stephens, Jr. ..... 204/147
3,841,988 10/1974 Gleason ..... 204/196
4,381,981 5/1983 Maes ..... 204/148

*Primary Examiner*—Howard S. Williams
*Assistant Examiner*—Terryence Chapman
*Attorney, Agent, or Firm*—William J. Daniel

[57] ABSTRACT

An aluminum article is protected against electrochemical corrosive attack by an aqueous medium with which the article is at least partially in contact by the steps of observing the cathodic potential of the article relative to a reference electrode in contact with the medium; when the observed cathodic potential of said article approaches the potential at which pitting corrosion of the same is initiated, electrically connecting said article directly to a source of potential electronegative with respect to the observed potential of the article to repress the cathodic potential of said article to within the alkali corrosion range; and after the cathodic potential is repressed within the alkali corrosion range, disconnecting the article from said electronegative potential source to allow the article to gradually return to its natural cathodic potential in the medium.

7 Claims, 4 Drawing Figures

METHOD FOR CATHODIC PROTECTION OF ALUMINUM MATERIAL

FIELD OF THE INVENTION

This invention relates to a method for the cathodic protection of an article of aluminum or an aluminum alloy (hereinafter collectively referred to, for sake of convenience, simply as "aluminum") against electrochemical corrosion by periodically briefly reducing the cathodic potential of the article when such potential approaches that at which such corrosion would be initiated.

BACKGROUND OF THE INVENTION

Aluminum is a metallic material of light weight, good thermal conductivity, and relatively high resistance to corrosion in a neutral atmosphere. Thus, it has recently come into widespread popular usage in the form of structural members for chemical equipment and vessels, for example. It is known, however, that when aluminum structural members are used in heat exchangers and liquid storage tanks which are directly exposed to sea water or industrial water (hereinafter generally referred to as "water"), they often develop pitting or grain boundary corrosion, i.e., the phenomenon of uneven corrosion, attributable to a so-called electrochemical cause. Such pitting or grain boundary corrosion of aluminum articles in contact with water is one form of electrochemical phenomenon which is caused by a potential difference between the article and water. As measures for the protection against said electrochemical corrosion of aluminum materials used in environments exposed to water as described above, application of an anodic oxide coating on the surface of such aluminum materials and/or application of a film of paint to such surface have been accepted in actual practice and do prevent such corrosion at least to some extent. When coating of oxide and films of paint alone are relied upon, however, they cannot be expected to produce sufficient protection against corrosion over a long period because these coatings and film have potential faults of their own and the coating eventually undergoes degradation and the film peels off the substrate during prolonged service.

As a technique for the protection of metallic materials immersed in water against electrochemical corrosion, there has been heretofor known the so-called sacrificial anode method which involves attaching to a metallic material requiring protection another metallic material exhibiting a baser natural potential in water than the metallic material requiring protection thereby reducing the potential of the metallic material to be protected in water at all times below the pitting potential. Alternatively, there has been known the so-called cathodic protection method which involves causing a feeble anticorrosion current from an external power source to flow between the metallic material and an opposite electrode immersed in water, thereby keeping down the potential of the metallic material in water at all times below the pitting potential. These methods are widely used for the protection of steel materials against corrosion and are affording desirable results. Alternatively, a weak current from an external power source has been caused to flow between the article and an opposite electrode immersed in the water.

The present inventors made various studies in search for a method capable of protecting either aluminum materials having an anode oxide coating or a film of paint applied to the surface thereof or bare aluminum materials, immersed in water, against pitting or grain boundary corrosion by the application of the aforementioned sacrific anode or cathodic protection method. In all the tests, however, mere application of the conventional sacrifice anode method to such aluminum materials failed to afford the same satisfactory protection against corrosion as had been obtained for steel materials. The reason for this failure is that unlike steel, aluminum is a so-called amphoteric metal which dissolves in both acids and alkalis.

In has been known that for a given aluminum material to remain stable in water for a long time without substantially undergoing corrosion, the natural potential of the aluminum material in water should be maintained in a narrow range from about 0.3 V to 0.4 V below the pitting potential up to the pitting potential, although this range is slightly variable dependent upon the kind of alloy components used in the aluminum material or upon the nature of the environment in which the aluminum alloy is immersed in water. To ensure protection of the aluminum material against corrosion by the use of known methods, therefore, it is necessary that the cathodic potential of the aluminum article to be protected against corrosion should be controlled throughout the entire volume or mass of the aluminum material at all times so as to be retained within the aforementioned range of stable potential as much as possible. To ensure protection of the aluminum material against corrosion by the use of the sacrifice anode, therefore, it is necessary that the cathode potential of the aluminum material subjected to protection against corrosion should be controlled throughout the entire volume of the aluminum material so as to be retained within the aforementioned range of stable potential as much as possible. When the sacrifical electrode is formed of a metal which has potential relatively close to the natural potential of aluminum in water, the portion of the aluminum article which is in the vicinity of the sacrificial anode can be controlled at a proper potential owing to the cathode current flowing between the aluminum material and the sacrificial anode. In contrast, the portion of the aluminum article which is remote from the sacrificial anode cannot be given adequate control of potential because the flow of the cathode current is lowered, by the electrical resistance offered from water. Thus, this remote portion of the aluminum article inevitably suffers pitting or grain boundary corrosion. When the sacrificial anode is made of a metal possessing sufficiently baser natural potential than the aluminum so as to permit control of potential even in the portion of the aluminum material remotely separated from the sacrificial anode, the portion of the aluminum material close to the sacrificial anode is subjected to excessive potential which tends to induce the phenomenon of alkali corrosion due to so-called excessive anticorrosion. This is so with the application of the cathodic protection method wherein an external power source is used. That is, when the voltage of the external power source is controlled so as to maintain the cathode potential at the portion in the vicinity of the opposite electrode of the aluminum material in a proper range, the potential at the portion remote from the opposite electrode is insufficiently repressed. On the other hand, when it is contemplated to repress sufficiently the potential at the portion remote from the opposite electrode of the aluminum material, the potential at the portion in the vicinity of the opposite electrode is excessively repressed. Such excessive repression of the potential tends to cause dissolution, i.e. alkali corrosion, of the aluminum material. As described above, when the conventional sacrificial anode method or cathodic protection method with use of the external power source is relied on, it is difficult to effect control of the cathode potential of the entire volume of the aluminum material so that the potential may remain in the stable range. This difficulty has notably restricted the application of the sacrifice anode method to aluminum materials.

OBJECT OF THE INVENTION

This invention is aimed at overcoming the drawbacks entailed, as described above, in the conventional method for the cathodic protection of aluminum materials by the use of a sacrificial anode.

SUMMARY OF THE INVENTION

To be specific, this invention relates to a method for the cathodic protection of an aluminum article against corrosion in an aqueous medium by establishing a direct electrical circuit between the aluminum article and a source of potential electronegative with respect of the cathodic potential of the article for a brief period each time the cathode potential of the aluminum material measured relative to a reference electrode in contact with the medium rises to a predetermined upper limit of potential, not generally higher, and desirable somewhat lower, than the cathodic potential at which pitting corrosion would be initiated, thereby intermittently repressing the cathode potential of the aluminum material to within the alkali errosion range. In one embodiment, the source of electronegative potential is a sacrificial anode in contact with the medium and intermittently connected into an electrical circuit with the article. The reference electrode can be a separate electrode provided for that purpose or the sacrificial anode itself can also serve as the reference electrode. In another embodiment, an electrical circuit is intermittently established between the article and an external source of negative voltage.

BRIEF DESCRIPTION OF THE DRAWINGS

Now, the method of this invention will be described more completely with reference to a first embodiment shown in FIG. 1*a* and *b* of the accompanying drawings, in which:

In FIG. 1, the numeral 1 denotes an aluminum article immersed in water and requiring protection against corrosion and a reference electrode 2 is disposed under water near the aluminum material 1. Although a standard electrode such as a saturated calomel electrode may be used as the reference electrode 2, the reference electrode need not be limited to a calomel electrode. An electrode of metal or metal alloy using zinc or magnesium which exhibits relatively stable electrode potential despite changes in the external environment may also be effectively used as the reference electrode. The aluminum article 1 and the reference electrode 2 are connected with electrical lead wires to a potential measuring device 3 to form potential measuring circuits 6, 6'. As the cathode potential V of the aluminum article 1 based on the reference electrode 2 which is determined on the potential difference between the aluminum article 1 and the reference electrode 2 measured by the potential measuring device 3 rises to a predetermined upper-limit potential $V_U$, the potential measuring device 3 issues a signal indicating this fact to an electrical relay device 5. A sacrificial anode 4 is disposed under water and is connected via the relay device 5 to the aluminum article 1, thus establishing cathode current circuits 7, 7'. Normally, the cathode current circuits 7, 7' remain in an open or disconnected state. When, however, the potential of the aluminum article 1 reaches the upper-limit potential $V_U$, the signal from the potential measuring device 3 actuates the relay device 5 to close the cathode current circuits 7, 7' for a brief period. During this brief period, a direct electrical connection is created between the aluminum article 1 and the sacrificial anode 4. By this mechanism, the cathode current V of the aluminum material 1 is intermittently repressed.

FIG. 2 illustrates a time-course change in cathode potential occurring in the portion of an aluminum material which is to be protected against corrosion, relatively close to a sacrificial anode, as determined in working the method of this invention with the apparatus of FIG. 1*a* or *b* using an electrode of magnesium as the sacrificial anode. In the diagram, the vertical axis is a scale indicating the cathode potential of the aluminum material (potential based on a saturated calomel electrode) and the horizontal axis is a scale of time. From the diagram, it is noted that when the cathode potential V of the aluminum material 1 determined based on the potential difference between the aluminum material 1 and the reference electrode 2 (or the sacrificial electrode 4' in FIG. 1*b*) measured by the potential measuring device 3 rises and reaches the point $a_1$, namely the predetermined upper-limit potential $V_U$, the signal issuing from the potential measuring device 3 actuates the relay device 5 to close the cathode current circuits 7, 7' and establish a short-circuit for a brief period between the sacrificial anode 4, 4' and the aluminum material 1, with the result that the cathode potential V of the aluminum material 1 is abruptly lowered to the point $b_1$. When the cathode current circuits 7, 7' are subsequently opened, the cathode potential V immediately begins to rise. This rise of the cathode potential V is sharp in the initial stage and then gradual in the latter stage as illustrated by the curve $b_1-a_2$. As the cathode potential V of the aluminum material 1 returns to the point $a_2$ which is the upper-limit potential $V_U$, the potential measuring device 3 issues the signal which actuates the relay device. Thus, the cathode potential V is again lowered to the point $b_2$ and then rises along the curve $b_2-a_3$.

As is clear from the foregoing description, the method of this invention for the cathodic protection of an aluminum material provides intermittent repression of this cathode potential of the aluminum material by establishing a short circuit for a brief period between the sacrificial anode and the aluminum material each time the cathode potential of the aluminum material rises to the predetermined upper-limit potential $V_U$. In this method, the upper-limit potential $V_U$ of the aluminum material to be predetermined should be selected near the pitting potential in the environment in which the aluminum material is used (for example, about −0.70 V based on a saturated calomel electrode, for aluminum of grade A1100 used under sea water) or about 50 mV below the pitting potential, although this limit is somewhat variable with the type of alloy components used in the aluminum material or with the nature of the environment in which the aluminum material is used. The sacrificial electrode used in this case is preferably made of a metal alloy exhibiting an electrode potential about 0.3 to 0.8 V lower than the cathode potential of the aluminum material being protected against corrosion under the same working environment. When the aluminum material is used in an environment in which alkali corrosion is not readily induced, however, the sacrificial electrode may be made of a metallic material exhibiting an electrode potential at least 1 V lower than the aluminum material. The sacrificial anode satisfying the aforementioned requirement may be made of a material properly selected to suit the particular working environment from among know materials for sacrificial anodes which are composed preponderantly of magnesium and popularly used for the cathodic protection of steel materials. The period t during which the short circuit is established according to this invention between the sacrificial anode and the aluminum material when the cathode potential of the aluminum material has risen to the upper-limit potential need not be defined very exactly. Generally, this period falls in the range of 0.01 to 2 seconds. It may be increased to the order of several seconds unless the corrosive environment is one in which the aluminum material is particularly susceptible to alkali corrosion.

Figure 2:
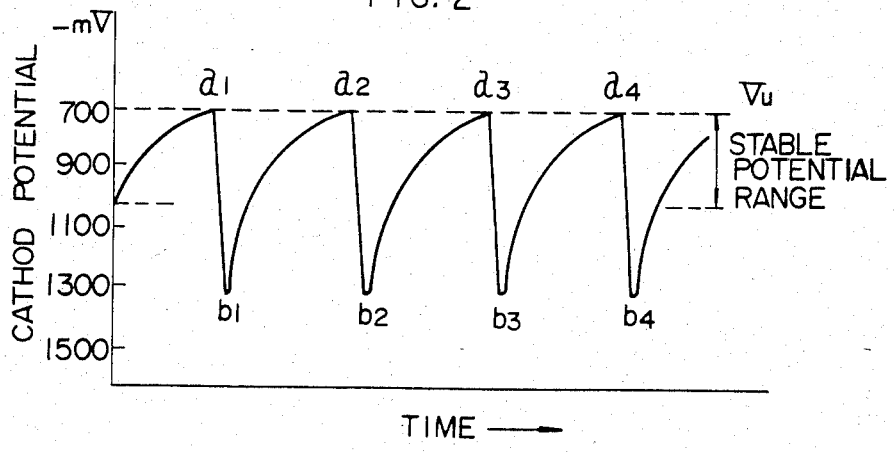
FIG. 2 is a diagram showing a typical time-course change of the cathode potential of an aluminum material to be protected against corrosion by the method of this invention.

As described above, the method of this invention aims to achieve intermittent or periodic repression of the potential of the aluminum material immersed in water by establishing an electrical connection, i.e. a circuit, for a brief period between the aluminum material and the sacrificial anode each time the cathode potential of the aluminum material rises to the neighborhood of the pitting potential. Thus, the potential of the aluminum material is maintained at all times below the pitting potential and, therefore, the aluminum material is protected without fail against pitting or grain boundary corrosion. Further as illustrated in FIG. 2, since the rise of the potential of the aluminum material after termination of the short circuit between the aluminum material and the sacrificial anode is quick in its initial stage and then gradual in its later stage, the period during which the aluminum material is exposed to alkali corrosion conditions is extremely short. Moreover, the phenomenon of alkali corrosion has an induction period. Even when the cathode potential is repressed momentarily into the alkali corrosion range, therefore, there is virtually no possibility of the aluminum material becoming subjected to alkali corrosion. As compared with the conventional method for cathodic protection, the method of the present invention permits use of a sacrificial anode having a sufficiently greater electronegative potential than the aluminum material as to provide protection of the entire volume or mass of a given aluminum article against electrochemical corrosion such as pitting or grain boundary corrosion without the possibility of inducing alkali corrosion. Further, since the method of this invention causes the flow of anti-corrosion current intermittently between the aluminum material and the sacrificial anode, it enjoys an additional advantage that the consumption of sacrificial anode is by far smaller than is experienced in the conventional method which necessitates the flow of such anti-corrosion current at all times.

Now, this invention will be described with reference working examples:

EXAMPLE 1

As a test piece for protection against corrosion, a plate of aluminum A1100 (800 mm in length × 100 mm in width × 1 mm in thickness) was prepared and subjected to the following experiment.

Water passages about 5 mm in width were formed on both sides of the test piece along its longitudinal direction. At a position spaced about 10 cm from one end of the aluminum plate, an anti-corrosion sacrificial anode (made of Mn alloy Az 63 containing 6.0% of Mg, 3.0% of Al, and 0.2% of Zn), 40 mm in width × 70 mm in length × 15 mm in thickness was disposed between the sacrificial anode and the test piece, a cathode current circuit was set up so as to permit establishment of a short circuit intermittently between the sacrificial anode and the test piece. As water for the test, natural sea water (having a temperature of about 20° C.) was caused to flow through the water passages at a flow rate of about 20 cm/sec.

As a reference electrode, a standard calomel electrode was disposed opposite the sacrificial anode across the test piece. Each time the potential of the test piece measured with reference to the potential of the reference electrode rose to a predetermined upper-limit potential (fixed at −0.70 V on the basis of a saturated calomel electrode), a potential measuring device issued a signal, which established a short circuit in the cathode current circuit for a brief period (fixed at 0.2 second). Thus, the potential of the test piece was intermittently controlled.

This experiment was continued for 10 months. During the course of this continued experiment, absolutely no pitting occurred and alkali corrosion was not observed.

EXAMPLE 2

As a test piece for protection against corrosion, a plate of aluminum A1100 (having the same size as the test piece of Example 1) was prepared and subjected to the following experiment.

Water passages were formed, similarly to Example 1, on both sides of the test piece. At a position spaced about 10 cm from one end of the sater passages, a metal electrode (made of a Mn alloy Az 63 containing 6.0% of Mg, 3.0% of Al, and 0.2% of Zn), 40 mm in width×70 mm in length×15 mm in thickness, was disposed to serve as a combination reference electrode and sacrificial anode. As water for the test, the same natural sea water as used in Example 1 was caused to flow at a flow rate of about 20 cm/sec.

Each time the potential of the test piece measured by a potential measuring device with reference to the potential of the metal electrode serving as the combination reference electrode and sacrificial anode rose to the predetermined upper-limit potential (fixed at −0.70 V on the basis of a saturated calomel electrode), the potential measuring device issued a signal, which established a short circuit in the cathode current circuit for a brief period (fixed at 0.1 second). Thus, the potential of the test piece was intermittently controlled. This experiment was contined for 10 months.

During the course of this continued experiment, absolutely no pitting occurred and alkali corrosion was not observed.

For the purpose of comparison, the same test piece as used in Example 2 and a sacrificial anode (made of the same material as in Example 2) attached to one end of the test piece were subjected to the same experiment without causing any interruption in the flow of anticorrosion current. About one month after the start of the flow of sea water, the portion of the aluminum plate adjacent to the sacrificial anode showed a seriously coarsened skin owing to alkali corrosion.

Figure 3:
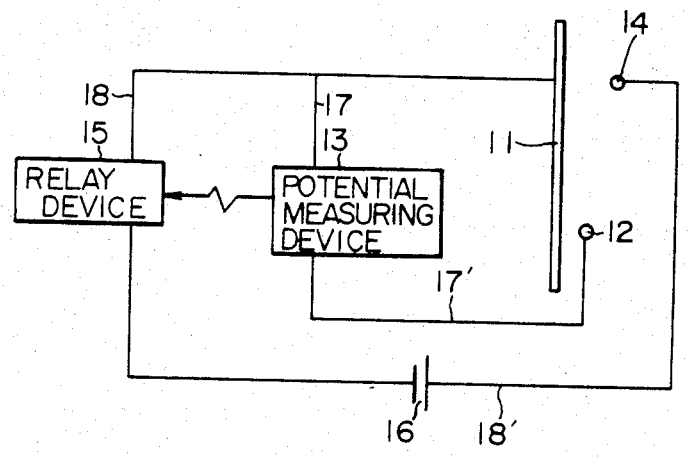
FIG. 3 is a schematic diagram illustrating a typical form of a second embodiment of the method of this invention.

FIG. 3 illustrates a typical form for the second embodiment of the method of this intention. In FIG. 3, 11 denotes an aluminum article immersed in water and requiring protection against corrosion, a reference electrode 12 being disposed in water near the article. Although a standard electrode such as a saturated calomel electrode may be used as the reference electrode 12, the reference electrode need not be limited to the calomel electrode. An electrode of metal or metal alloy using zinc or magnesium which exhibits relatively stable electrode potential despite changes in the external evironment may be effectively used as the reference electrode. The aluminum article 11 and reference electrode 12 are connected with lead wires to a potential measuring device 13 to form potential measuring circuits 17, 17'. As the cathode potential V of the aluminum article based on the reference electrode, as measured by the potential measuring device, rises and reaches a predetermined upper-limit potential $V_U$, the potential measuring device 13 issues a signal to a relay device 15. 14 denotes an opposite electrode. This opposite electrode is made of an insoluble electrically conductive material such as, for example, a magnetic iron oxide material or a platinum-coated titanium material. The opposite electrode 14 and article 11 are connected via the relay device 15 to an external power source 16, by way of the relay device 15 to an external power source 16, by way of cathode current circuits 18, 18'. Normally, the cathode current circuits 18, 18' remain in their open state. When the potential of the aluminum article rises to the upper-limit potential $V_U$, the signal from the potential measuring device 13 actuates the relay device 15 and closes the cathode current circuits 18, 18' for a brief period. During this brief period, anodic or negative current from the external power source 16 flows between the aluminum article and the opposite electrode 14 so as to repress the cathode potential V of the aluminum article 11.

Figure 1A:
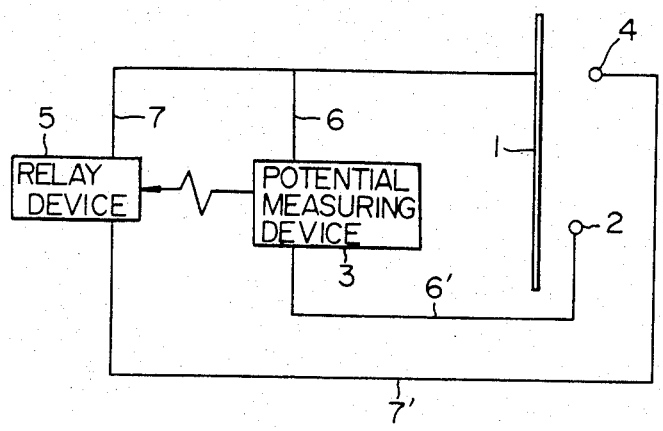
FIGS. 1*a* and *b* are schematic diagrams illustrating typical forms of a first embodiment of the method of this invention.
Figure 1B:
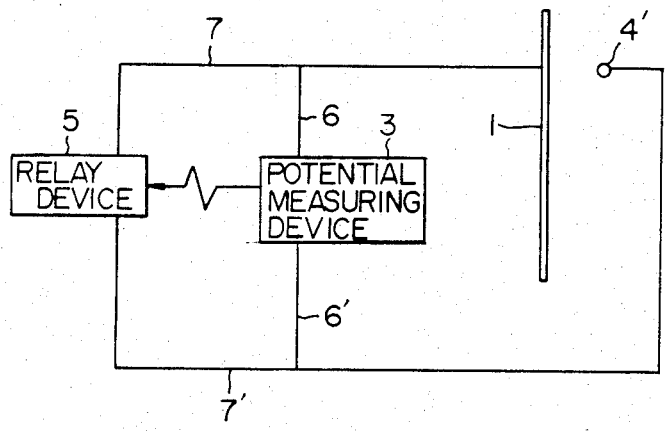
FIG. 1*b* illustrates another form for the first embodiment of the method of this invention. In the embodiment of FIG. 1*a*, the reference electrode 2 is disposed under water separately from the sacrificial electrode 4' so that when the cathode potential V of the aluminum material 1 based on the reference electrode 2 determined on the potential differences between the aluminum material 1 and the reference electrode 2 reaches the predetermined upper-limit potential $V_U$, the signal issuing from the potential measuring device 3 will actuate the relay device 5 to close the cathode current circuits 7, 7' and cause flow of short-circuit current between the aluminum material 1 and the sacrificial anode 2. By contrast, in the embodiment FIG. 1*b*, a separate reference electrode 2 is omitted and the sacrificial anode 4' is itself concurrently used as a reference electrode so that when the cathode potential V of the aluminum material 1 determined based on the potential difference between the sacrificial anode 4' and the aluminum material 1 reaches the predetermined upper-limit potential $V_U$, the potential measuring device 3 will issue a signal to actuate the relay device 5 and close the cathode current circuits 7, 7' for a brief period and allow short-circuit current to flow between the aluminum material 1 and the sacrificial anode 4'. In this manner, the cathode potential of the aluminum material 1 is intermittently repressed.

Typically, the cathode potential changes in the second embodiment of FIG. 3 in the same pattern as occurs in the first embodiment of FIG. 1, i.e. as represented in FIG. 2. Thus, again referring to FIG. 2, when the cathode potential V of the aluminum article measured by the reference electrode 12 rises and reaches the predetermined upper-limit potential $V_U$, the signal issuing from the potential measuring device 13 actuates the relay device 15 and closes the cathode current circuits 18, 18', with the result that a negative voltage is applied by the external power source 16 to the aluminum article for a brief period and its cathode potential V is abruptly lowered to the point $b_1$. When the application of the voltage from the external power source 16 is ceased, the cathode potential V of the article immediately begins to rise. This rise of the cathode potential V is fast in its initial stage and then gradual in its later stage as shown by the curve, e.g. $b_1 \rightarrow a_2$. When the cathode potential V returns in this manner to the point $a_2$ which is the upper-limit potential $V_U$, the signal from the potential measuring device 13 again actuates the relay device and the cathode potential V is again lowered abruptly to the point $b_2$, from which it rises as before.

In the alternative embodiment of this invention, the upper-limit potential $V_U$ of the aluminum material to be predetermined is, like in the first embodiment, desired to be fixed near the pitting potential of the aluminum material to be used (for example, about −0.70 V based on a saturated calomel electrode, for aluminum of grade A1100 used under sea water) or about 50 mV below the pitting potential, although this limit, as before, is somewhat variable depending on the kind of alloy components used in the aluminum material or with the nature of the environment in which the aluminum material is used. The magnitude of the voltage to be applied from the external negative source is desired to be such that the application of this voltage will cause the cathode potential of the aluminum material to fall rapidly to the level of about 0.3 to 0.8 V below the upper-limit potential. When the aluminum material is used in an environment in which the alkali corrosion is not readily induced, however, this drop of the cathode potential may be to 1 V or more below the upper-limit potential. The application of such negative voltage to the aluminum material can be accomplished by adjusting the magnitude of the voltage of the external power source to a fixed level. Otherwise, it may be effected by establishing a lower-limit potential $V_L$ in lieu of adjusting the voltage of the external power source, so that when the cathode potential V of the aluminum material measured by the reference electrode 2 has dropped after the application of the negative voltage to the lower-limit potential $V_L$, the signal from the potential measuring device 13 will actuate the relay 15 and open the cathode current circuits 18, 18' automatically. In this manner, a wide range of negative voltages is available while the change in cathodic potential of the article remains constant.

The duration of the application of the negative voltage to the aluminum material in one cycle, though variable with the magnitude of the negative voltage and the nature of the working environment involved, should be kept at least below several seconds so as to avoid exposing the aluminum material for any appreciable time to the alkali corrosion zone inducible by the decline of the potential. Preferably this duration should be not more than 1 second and can be a few hundredths or tenths of a second. Thus, the duration through which the potential of the aluminum material substantially remains in the alkali corrosion zone is extremely short. Further, as stated before, the phenomenon of alkali corrosion has an induction period. There is, consequently, virtually no possibility of the aluminum material being subjected to alkali corrosion within this duration. Even when the magnitude of the negative voltage applied to the aluminum material is large as compared with that involved in the conventional cathodic protection method using an external power source and necessitating constant flow of cathode current, the possibility of the aluminum material undergoing alkali corrosion due to excessive anticorrosion is quite remote. Even under a harsh condition, the aluminum material is protected throughout the whole volume thereof against corrosion quite effectively.

Now, the practice of the alternative embodiment is illustrated by the following working example:

EXAMPLE 3

As a test piece for protection against corrosion, a plate of aluminum A1100 (800 mm in length×100 mm in width×1 mm in thickness) was prepared and subjected to the following experiment.

Water passages about 5 mm in width were formed on both sides of the test piece along the longitudinal extent thereof. At a position spaced about 10 cm from one end of the test plate, an opposite electrode for anticorrosion 10 mm in diameter and 10 mm in length (made of ferrite) was disposed. Between this electrode and the test piece, there was disposed a cathode current circuit capable of passing electric current when actuated by relay 15 so as to convert the test piece intermittently into a cathode. As water for the experiment, natural sea water (having a temperature of about 20° C.) was caused to flow in the water passages at a flow rate of about 20 cm/sec.

A reference electrode (calomel electrode) was disposed opposite the opposite electrode across the test piece. Each time the potential of the test piece measured on the basis of the reference electrode rose and reached the predetermined upperlimit potential (fixed at −0.70 V), the signal issuing from a potential measuring device closed the cathode current circuit automatically for a brief period (fixed at 0.06 second). In this manner, the negative voltage from the external power source (a constant-voltage power source of −2.5 V) was applied repeatedly between the test piece and the opposite electrode. During the experiment, the cathode potential of the test piece rose and fell alternately at intervals of about 2 to 3 seconds between the upper-limit potential and the potential about 0.6 V below the upper-limit potential.

This experiment was continued for 10 months. During the course of this experiment, absolutely no pitting occurred and alkali corrosion was not observed.

For the purpose of comparison, the same test piece as involved in the preceding experiment was subjected to the same procedure as described above, except the flow of anticorrosion current was omitted. One week after the start of the flow of sea water, occurrence of pitting was observed.

We claim:

1. A method for the cathodic protection of an aluminum article against electrochemical corrosive attack by an aqueous medium with which the article is at least partially in contact, which method comprises the steps of observing the cathodic potential of said article relative to a reference electrode in contact with said medium; when the observed cathodic potential or said article approaches the potential at which pitting corrosion of the same is initiated, electrically connecting said article directly to a source of potential which is sufficiently electronegative with respect to the observed potential of said article to repress the cathodic potential of said article to within the alkali corrosion range of said article; and after said cathodic potential is repressed to within the alkali corrosion rate but before said article undergoes sufficient alkali corrosion, disconnecting the article from said electronegative potential source whereby the cathodic potential of said article gradually rises to its natural potential in said medium.

2. The method of claim 1 wherein said article is electrically connected to said electronegative potential source for a period of about 0.01–2 sec.

3. The method of claim 1 wherein said electronegative source is a sacrificial anode at least partially in contact with said medium.

4. The method of claim 3 wherein said sacrificial anode is also used as said reference electrode.

5. The method of claim 3 wherein an electrode different from said sacrificial anode is arranged in contact with said medium to serve as said reference electrode.

6. The method of claim 1 wherein said electronegative potential source is an opposite electrode in contact with said medium and connected to an external source of negative current relative to said cathodic current.

7. The method of claim 6 wherein the negative voltage of said external power source exceeds the level of potential to which the article potential is repressed, and including the step of disconnecting said article when its cathodic potential reaches a predetermined lower level within said alkali corrosion range.

* * * * *

UNITED STATES PATENT AND TRADEMARK OFFICE

CERTIFICATE OF CORRECTION

PATENT NO. : 4,510,030

DATED : April 9, 1985

INVENTOR(S) : Teruo Miyashita et al

It is certified that error appears in the above-identified patent and that said Letters Patent is hereby corrected as shown below:

In the Claims:

Claim 1, line 7, "or" should read -- of --.

Signed and Sealed this

*Twenty-third* Day of *July 1985*

[SEAL]

*Attest:*

DONALD J. QUIGG

*Attesting Officer* *Acting Commissioner of Patents and Trademarks*